United States Patent [19]

Keller et al.

[11] 4,357,978

[45] Nov. 9, 1982

[54] ROLLER SHADE SEAL SYSTEM

[75] Inventors: Robert R. Keller; Richard Steinberg; John P. Whittemore, all of Bedford, N.H.

[73] Assignee: Keller Products, Inc., Manchester, N.H.

[21] Appl. No.: 245,595

[22] Filed: Mar. 19, 1981

Related U.S. Application Data

[63] Continuation-in-part of Ser. No. 155,192, Jun. 2, 1980.

[51] Int. Cl.[3] ..... E06B 7/16

[52] U.S. Cl. ..... 160/41; 160/271

[58] Field of Search ..... 160/133, 270, 271, 272, 160/273, 290, 41; 52/202, 213, 214; 312/338

[56] References Cited

U.S. PATENT DOCUMENTS

| | | | |
|---|---|---|---|
| 1,972,182 | 9/1934 | Chamberlain et al. | 160/41 |
| 2,247,634 | 7/1941 | Houston | 160/41 |
| 2,270,978 | 1/1942 | Swormstedt | 160/267 |
| 2,509,898 | 5/1950 | Peremi et al. | 160/272 |
| 3,126,049 | 3/1964 | Hollands | 160/271 |
| 3,196,935 | 7/1965 | Christensen | 160/267 |
| 3,990,635 | 11/1976 | Restle et al. | 160/23 C |
| 3,992,815 | 11/1976 | Potter | 52/202 |
| 4,220,189 | 9/1980 | Marquez | 160/23 R |
| 4,258,517 | 3/1981 | Hammond | 160/290 R |

FOREIGN PATENT DOCUMENTS

| | | | |
|---|---|---|---|
| 1020785 | 2/1966 | United Kingdom | 160/273 R |
| 1079504 | 8/1967 | United Kingdom | 160/23 |
| 1545508 | 5/1979 | United Kingdom | 160/273 R |

OTHER PUBLICATIONS

Document No. 1251480, dated 10/67.

*Primary Examiner*—Peter M. Caun

*Attorney, Agent, or Firm*—Strimbeck, Davis & Soloway

[57] ABSTRACT

A simple, relatively low cost system for sealing an ordinary roller shade with respect to the window frame sides, top and bottom is provided. The roller shade seal system essentially comprises a pair of edge seal assemblies in the form of elongate mounting strip members adapted to be permanently mounted to opposite vertical faces of the window frame trim, and a pair of sealing strip members in the form of elongate, generally U-shaped channels adapted to sealably engage the latter edges of the shade, releasably mounted to an associated mounting strip. The window shade sealing system is completed by a shade bottom edge seal comprising a rigid bottom strip reinforcing member, a sill sealing strip and a shade top sealing member.

10 Claims, 9 Drawing Figures

ROLLER SHADE SEAL SYSTEM

This is a continuation-in-part of Ser. No. 155192 filed June 2, 1980.

The present invention relates in general to a roller screen assembly for an aperture, and more particularly to a window shade assembly for reducing thermal energy passage through a window.

It is increasingly being realized that south facing windows in particular, and east and west facing windows to a lesser extent, formed of glass or clear or translucent plastic have the potential of admitting large amounts of solar radiation and natural light to a building enclosure during bright daylight hours, thus reducing daylight energy requirements for heating and lighting the building. However, the poor thermal insulating properties of glass and plastic allow a large percentage of this heat energy gain to be lost back through the windows, particularly at night or on dark, cloudy days. In a well-insulated building, openings such as windows, skylights, and clerestories can be one of the largest sources of building heat loss in a northern climate. As is well known energy losses through windows can be substantially reduced by double glazing the window apertures; however, even with double glazing a typical window may lose heat at a rate of three or more times faster than an equal area of a well-insulated wall.

Heat is transferred through glazed openings by two methods, either by conduction through the glass or plastic glazing and associated air films from the interior surface of the glazing to the exterior, or by infiltration, i.e. the exchange of warmed indoor air with cold outdoor air through tiny cracks around window frames, breaks in the glazing and the like. With the recent attention being given to energy conservation, the art has turned its attention to reducing heat loss through window openings without seriously adversely affecting the potential for solar energy gain through the same windows.

In order to accomplish these purposes the art has proposed various means for decreasing the velocity of the flow of inside air against the glass or plastic glazing so as to in turn increase the heat transfer resistance of the air film adjacent the interior surface of the glazing. One such means comprises moveable insulating shutters or interlocking slats for insertion over window apertures at night, or on dark, cloudy days. Such shutters are designed to reduce both conduction and infiltration of cold air around window edges and the like by creating a dead air space between the window and the shutter. In practice, however, this can be difficult to achieve since an effective seal is hard to obtain, and poorly fitted shutters allow a convective air flow between the insulation and glazing, thus increasing transfer of heat through the glazing. Also, storage facilities must be provided for the shutters when not in place.

Recently, the art has proposed a number of movable thermal insulation systems for windows in the form of retractable insulating shades. One such insulating shade comprises a quilted sandwich comprising a reflective vapor barrier sandwiched between thin layers of batting insulation and encased in a skin, and is available from Appropriate Technology Corporation, Brattleboro, Vermont, under the name "Window Quilt". Disadvantages of the Window Quilt are that the rolled-up shade is substantially oversized as compared with an ordinary window shade, and the shade also requires a second so-called seal roller for pressing the quilt against the upper window frame trim in order to seal the quilt at the window top edge. As will be appreciated the oversized roller, combined with the second seal roller are somewhat unsightly. Accordingly, a large header or valance generally is installed in combination with the Window Quilt for hiding the two rollers. The Window Quilt also requires special tracks mounted to the surface of the window frame side trim for sealing its side edges. As a result the Window Quilt is relatively expensive to purchase, and it requires a certain amount of carpentry skills to install. While the Window Quilt is believed to have achieved some degree of commercial success, it also is believed objectionable to many consumers for decorative reasons and cost.

Another prior art retractable insulating shade which has achieved some degree of commercial success comprises a roll-down shade employing a plurality of hinged, hollow rigid slats. The latter is available from Solar Construction Company, Valley Forge, Pennsylvania, under the name "Thermo-Shade". However, the Thermo-Shade also requires mounting to the surface of the window frame trim, special window frame trim surface mounted side tracks, and oversized headers or valances, all of which are relatively costly to purchase and difficult to install. Also available are multi-layer retractable insulating shades comprising either a plurality of roll-up shades and rollers in a common frame, or shade having a plurality of layers on a single roller. Examples of such types of commercially available shades are the so-called "Insealshaid" available from Arc-Tic-Seal Systems, Inc., Butler, Wisconsin, the "High 'R' Shade" available from Insulating Shade Company, Bradford, Connecticut, and the "Curtain Wall" available from Thermal Technology Corporation, Snowmass, Colo. All of these currently available insulating shades are relatively expensive to purchase and are difficult to install, require a special valance or header to conceal the shade rollers, and special side tracks which are uniquely designed for use with the particular companion shade.

Accordingly, a primary objective of this invention is to provide a retractable insulation system for windows which substantially overcomes and avoids a number of the aforesaid problems encountered in prior art retractable thermal insulating shades for windows. Another object is to provide a low cost retractable thermal insulating system for windows which can be manufactured using relatively simple, currently available materials. Yet other objections of the invention are (1) to provide a retractable thermal insulating system for windows which can be mounted either within the window frame or over the window frame, (2) makes use of existing roller shades, and (3) requires only a small, unobtrusive header.

As is well known in the art an ordinary shade installation with open sides, top and bottom permits air circulation induced by thermal and infiltration action. This circulation places warm air against the interior surface of the window glazing as well as decreasing the air film resistance at the glazing and shade surface.

It has been determined that for purposes of insulating a window, an ordinary roller shade, originally installed for darkening the room and for privacy, if properly sealed across the window opening, will provide an effective, low cost means for also reducing heat transfer at a window opening. The present invention thus provides a simple, relatively low cost system for sealing an ordinary roller shade with respect to the window frame sides, top and the bottom. According to the present invention there is provided a roller shade seal system for a window shade comprising in combination a pair of edge seal assemblies in the form of elongate mounting strip members, adapted to be mounted to opposite faces of the window frame trim, and a pair of sealing strip members in the form of elongate, generally U-shaped channels adapted to sealably engage lateral edges of a said shade; means associated with said edge seal assemblies for releasably mounting each of said sealing strip members to an associated mounting strip member; a shade bottom edge seal assembly comprising a rigid bottom strip reinforcing member for mounting onto the bottom end of a said shade; and a window sill sealing strip means adapted and arranged to cooperate with said shade bottom reinforcing member to provide a seal at said window sill; and a shade top seal having mounted thereon a resiliently deformable sealing means for sealably engaging the outer turn of a said shade adjacent the roller end.

The invention will not be described, by way of example, with reference to the accompanying drawings, in which.

As used herein the term "window" is meant to encompass not only conventional ventilation and/or light emitting openings in buildings, but also solar energy emitting walls, skylights, and doorways. Moreover, the invention will be described particularly as it pertains to the reduction of heat loss through a window opening from an interior, heated space. One skilled in the art will recognize, however, that the invention may also be advantageously employed for reducing unwanted heat gain through a window opening, i.e. thus reducing cooling energy requirements.

Referring now to FIGS. 1 to 4 of the drawings, there is illustrated a first embodiment of the present invention comprising a conventional window roller screen in combination with a window shade edge, bottom and top seal arrangement of the present invention. The illustrated roller screen includes a standard spring/pawl roller 10 of conventional construction mounted in a bracket 12. The latter is attached to the inwardly facing window frame trim pieces only one of which 14, is shown, by suitable fastening means, such as nails or screws (not shown). A flexible screen material 16 is wound on the roller 10. Screen material 16 may comprise a cloth or plastic material and may be opaque, translucent or transparent.

Figure 1:
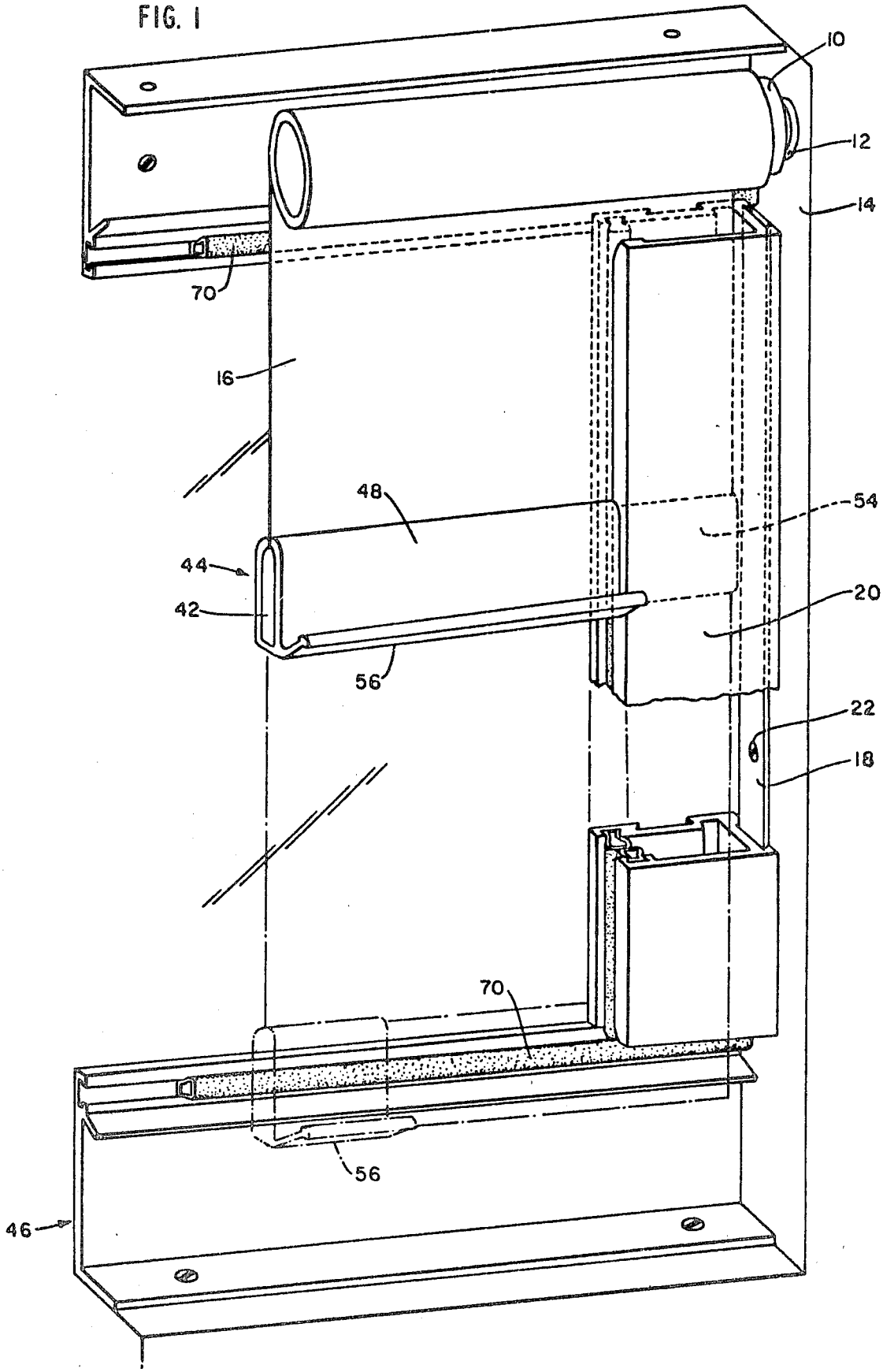
FIG. 1 is a perspective view, partly in section, of a first embodiment of retractable window shade sealing system according to the invention.
Figure 2:
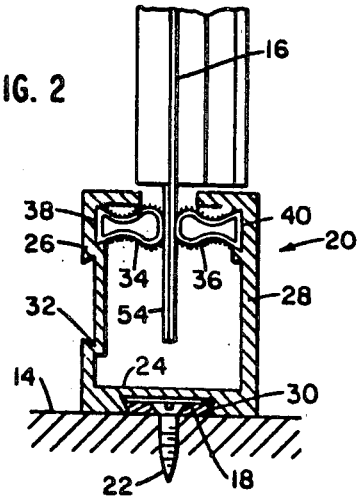
FIG. 2 is a sectional plan view of the mounting strip and side sealing strip assembly of the first embodiment.

As noted supra the roller shade seal system of the prevent invention includes a pair of edge seal assemblies in the form of elongate mounting strip members 18 (only one of which is shown) affixed to opposite side frame trim pieces 14, and a pair of sealing strip members 20, (only one of which is shown) mechanically releasably mounted to an associated mounting strip member 18. As best seen in FIGS. 1 and 2, mounting strip members 18 and sealing strip members 20 comprise tongue and groove mating members. Typically mounting strip member 18 will comprise an elongate, tapered tongue member which is secured to the window frame trim piece 14 by means of mechanical fasteners such as screws 22 vertically spaced along the trim piece 14. Obviously, mounting strip members 18 can be secured to the window frame trim by adhesive means. Also, one skilled in the art will recognize that the mounting strip tongue also may be formed integrally with the window frame trim pieces, e.g. as by extrusion. Such a trim piece may be applied to a window frame in the case of new construction.

Figure 5:
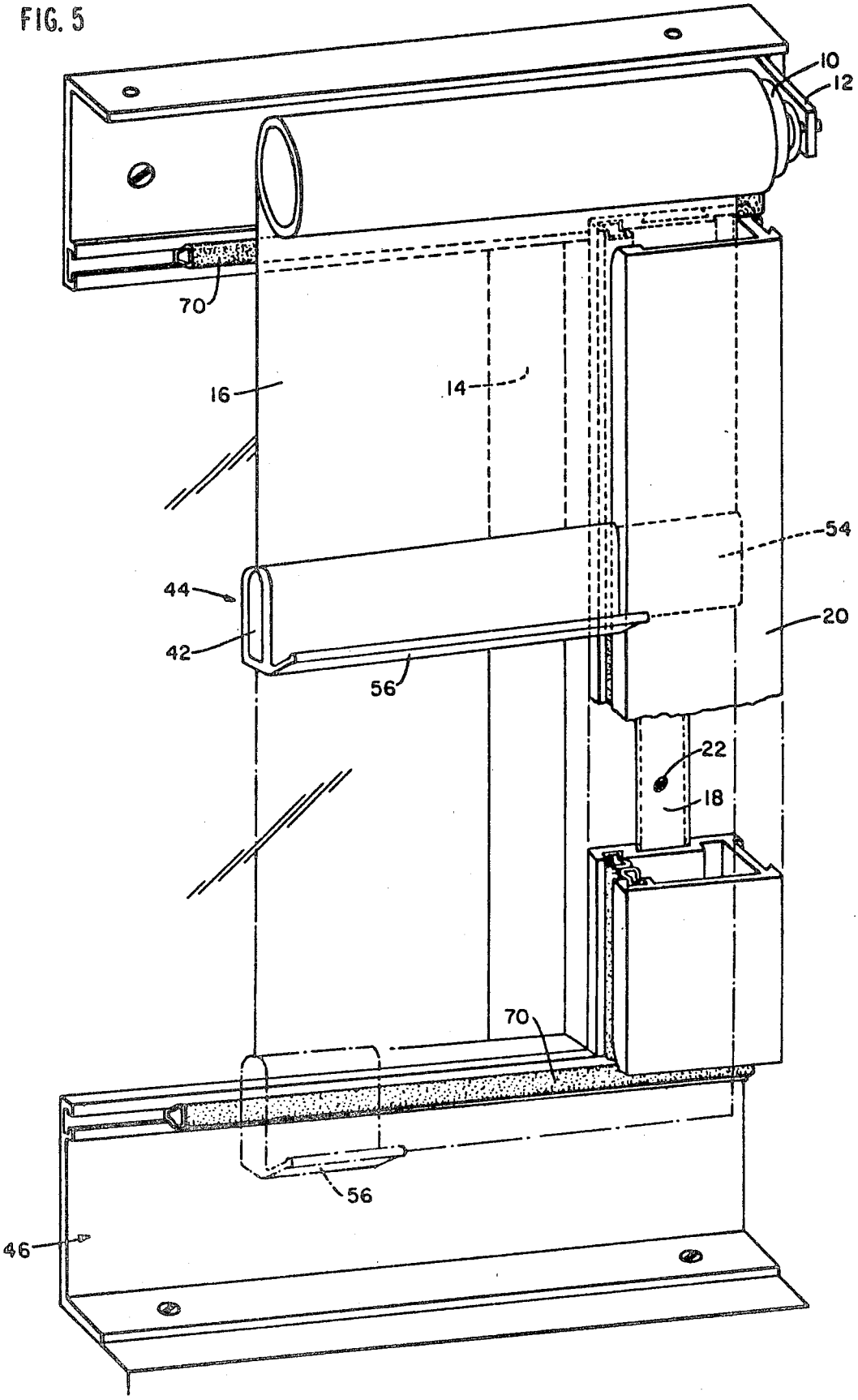
FIG. 5 is a perspective view, partly in section of the window shade sealing system of FIG. 1, shown mounted on the surface of a window frame opening.

Sealing strip member 20 comprises an elongate, generally U-shaped channel member having an elongate base wall 24, and a pair of elongate web walls 26 and 28. As best seen in FIG. 2, tapered grooved recesses 30 and 32 are formed in the surface of base wall 24 and one of the web walls 26. Recesses 30 and 32 are of suitable shape and dimension for snap-on/snap-off mating assembly to the tapered tongue of mounting strip member 18. As will become clear from the description following, providing recesses 30 and 32 on two of the channel walls 26 and 28, respectively, is preferred as it permits one to mount the mounting strip member 18/sealing strip member 20 assembly either within a window frame as illustrated in FIG. 1, or on the surface of the window frame as illustrated in FIG. 5. Obviously, one or the other recess may be omitted, if desired. Sealing strip member 20 is formed of a material which is sufficiently resiliently deformable to permit repeated snap-on and snap-off assembly of the sealing strip member 20 to the mounting strip member 18. Preferably mounting strip member 18 and sealing strip member 20 both will comprise an extruded rigid plastic material. Obviously mounting strip member 18 may be formed of a metal such as aluminum and may be extruded or machined. However, extruded plastic materials generally are preferred for initial cost considerations, ease of trimming and assembly, and thermal conductivity characteristics.

Completing the side edge sealing means are resilient sealing means such as fiber pile weatherstrip pads 34 and 36 provided on the inwardly directed channel walls 26 and 28, respectively. Obviously, weatherstrip pads 34 and 36 may be retained in place by other means such as an adhesive.

The bottom 42 of the flexible shade carries a rigid, generally L-shaped reinforcing channel member 44 which doubles as a shade pull. As seen particulary in FIG. 3 reinforcing channel member 44 includes a pair of elongate webs 48 and 50 which are shaped and dimensioned so that the channel member can be slipped over and capture the window shade lower (free) edge and the window shade bottom reinforcing stick 52. Also, as seen in FIG. 1, web 48 includes an integral outwardly directed flange 56 which provides a convenient hand pull. Obviously, shade pull flange 56 may be shorter, and if desired, fixed directly to the shade lower edge, e.g. by fastening directly onto the shade bottom reinforcing stick 25 by screw means or the like. Preferably channel member 44 is formed from rigid, extruded plastic material, or it can be formed of extruded metal such as aluminum.

Sill sealing member 46 comprises an elongate generally L-shaped member which comprises an elongate base section 60 for mounting to the window sill 61, e.g. with suitable fastening means such as screws 63 or the like, and an elongate flange 64 integral with the base section 60. As seen in the drawings flange section 64 preferably includes an elongate tapered channel 68 in which is mounted a resiliently deformably sealing means such as a fiber pile weatherstrip pad 70. Obviously tapered channel 68 is not required for mounting the weatherstrip pad 70 which may be retained in place on flange 66 by other means such as an adhesive. Sill sealing member 46 may be formed from rigid, extruded plastic, or extruded metal as before.

Figure 4:
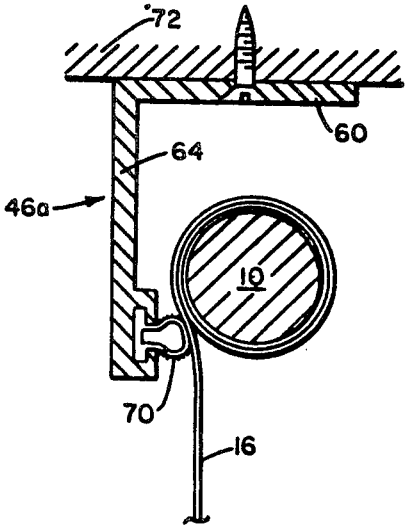
FIG. 4 is a side elevational view, in cross-section, of the shade top seal portion of the first embodiment.
Figure 3:
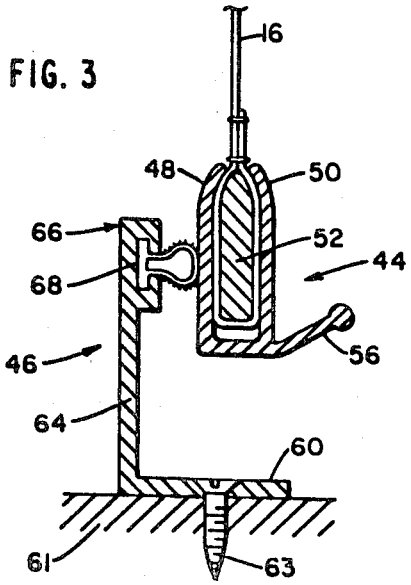
FIG. 3 is a side elevational view, in cross-section, of the sill mounted sealing strip portion of the first embodiment.

Completing the shade sealing means is the shade top edge sealing member 46*a* (see FIG. 4). Preferably shade top edge sealing member 46*a* is identical in construction to the sill sealing member 46. However, as seen in the drawings the sealing member is installed 180° inverted so that the base section 60 is mounted to the window inside top trim piece 72. As seen particularly in FIG. 4, weatherstrip pad 70 makes sealing engagement with the outer turn of the shade flexible screen material 16 adjacent the shade roller end.

Figure 6:
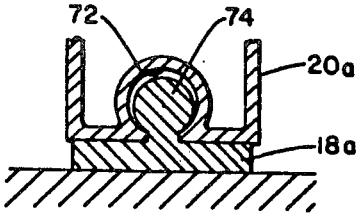
FIG. 6 is a sectional plan view showing details of an alternative mounting strip and side sealing strip assembly of the first embodiment.

FIG. 5 shows the window shade sealing system of the present invention mounted on the surface of a window opening. A modification is shown in FIG. 6 in which the side sealing strip member 20*a* has an elongate socket 72 for mating with an elongate bead 74 on a side mounting strip member 18*a*. Also, if desired the fiber pile weatherstrip 70 (or a resilient foam weatherstrip could be mounted on channel member 44 web 48, facing the sill mounted sealing strip flange 64. Obviously, the roller shade seal system of the present invention may also be advantageously employed in its entirety, or in part, with many of the commercially available retractable insulating shades as discussed supra. The roller shade seal system of the present invention may also be advantageously employed to seal a roll-up insect screen where such a product may be desired for access for cleaning or for winter storage.

Figure 8:
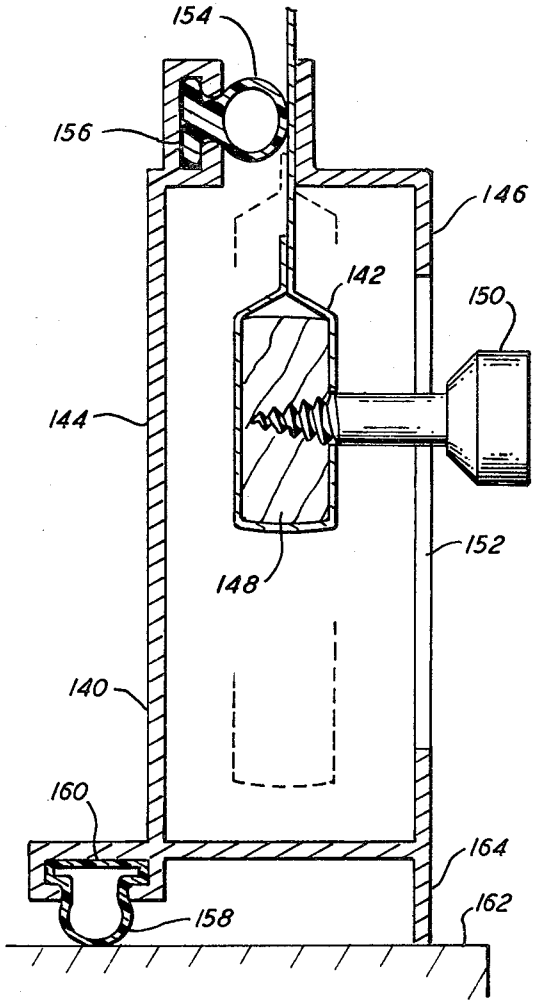
FIG. 8 is a side elevational view, in cross section, of the sill sealing arrangement of the second embodiment.
Figure 7:
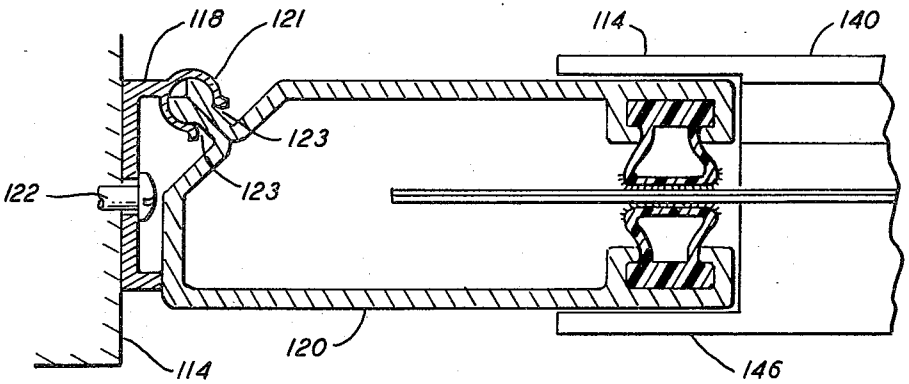
FIG. 7 is a sectional plan view of the mounting strip and side sealing strip assembly of a second embodiment of retractable window shade sealing system according to the invention.

Referring now to FIGS. 7 and 8 of the drawings, there is illustrated a second embodiment of the present invention comprising a conventional window roller screen in combination with a window shade edge, bottom and top seal arrangement of the present invention. The roller screen includes a standard spring/pawl roller of conventional construction mounted in a bracket attached to the inwardly facing window frame trim pieces. A flexible screen material is wound on the roller.

As noted supra the roller shade seal system of the present invention includes a pair of side edge seal assemblies in the form of elongate mounting strip members 118 (only one of which is shown) affixed to opposite inwardly facing side frame trim pieces 114, and a pair of sealing strip members 120, (only one of which is shown) mechanically releasably mounted to an associated mounting strip member 118. Each associated pair of mounting strip members 118 and sealing strip members 120 have a bead and socket mating arrangement 121. Typically mounting strip member 118 will comprise an elongate member having formed along one edge an elongate socket captively/releasably to receive an elongate bead and support flange forming a part of the sealing strip member 120. Strip member 118 is secured to window frame trim piece 114 by a plurality of screws 122.

The elongate socket and bead are arranged to provide for approximately 30° of angular misalignment between the members 118 and 120, by virtue of the clearance 123 between the socket opening and the bead support flange. The bead projects and the opening of the socket faces at approximately 45° to the plane occupied by the shade when lowered, thereby to facilitate alternative mounting arrangements discussed below with reference to FIG. 9.

Sealing strip member 120, apart from the arrangement by which is is attached to window trim, is quite similar to sealing strip member 20.

In the second embodiment the sill sealing member (46 in the first embodiment) and the reinforcing channel member (44 in the first embodiment) are omitted as separate entities and are replaced by a combined sill seal and shade bottom reinforcing member 140 arranged to move up and down with the shade and to seal against the sill trim when the shade is in a fully lowered position.

The bottom 142 of the flexible shade carries the combined sill seal and reinforcing member 140. The combined sill seal and reinforcing member 140 includes a pair of elongate webs 144 and 146 which are shaped and dimensioned so that the channel member can be slipped over and capture the window shade lower (free) edge and the window shade bottom reinforcing stick 148. Although the window shade bottom is encompassed by the combined sill seal and reinforcing member 140, the shade bottom is permitted a degree of vertical freedom within a range, the extremes of which are shown in ghost. A shade pull 150 is rigidly attached to the shade reinforcing stick (or, alternatively, to the shade material adjacent the bottom) and projects through a vertically disposed elongate opening 152 in web 146.

A flexible weatherstrip pad forms elongate sealing means 154 captively held in channel 156 formed to face inwardly from web 144 to seal against the shade in the opening formed between the webs 144, 146 through which the shade passes to the shade bottom 142 captively held in the combined sill seal and reinforcing member 140.

A flexible weatherstrip pad also forms elongate sealing means 158 captively held in downwardly facing channel 160 to seal the member 140 and shade against the upper surface of the sill trim 162 when the shade is in a fully lowered position with the shade bottom occupying an intermediate vertical position (e.g. as shown in FIG. 8). A downwardly extending flange 164 serves to balance the member 140 in an upright position on the sill trim 162 when the shade is in a fully lowered position.

Sealing strip members 120 extend downwardly to the sill trim 162 and webs 144, 146 extend partially over them (see FIG. 7) whereby the member 140 is guided by the members 120 during the raising and lowering of the shade.

Completing the shade sealing means of the second embodiment is a shade top edge sealing member similar to that of the first embodiment.

Figure 9:
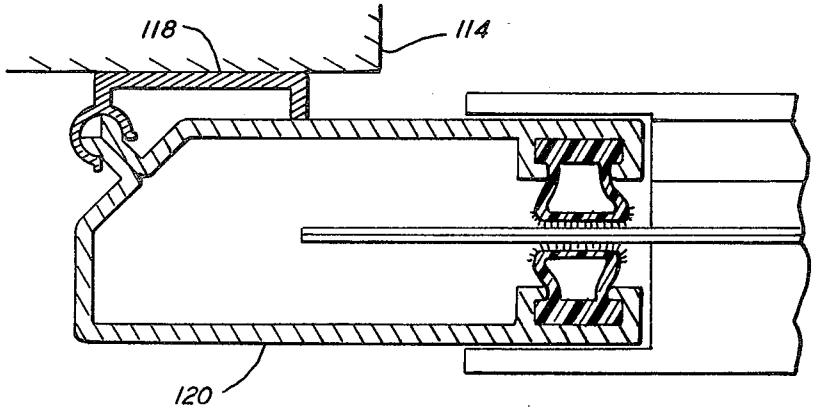
FIG. 9 is a sectional plan view similar to that of FIG. 7 illustrating an alternative mounting arrangement.

FIG. 9 shows the sealing strip members 120 of the second embodiment mounted by means of mounting strip member 118, reversed compared to FIG. 7, on the face of a window opening.

One skilled in the art will appreciate that roller shade sealing systems constructed in accordance with the teachings of the present invention may be readily and inexpensively constructed. The entire sealing system requires only four extruded plastic parts, and some fiber pile weatherstrip. The latter is readily available commercially. Also, the roller shade sealing system of the present invention permits retrofit use of existing roller shades. Furthermore, new installations of a retractable shade and heat barrier in accordance with the present invention may be accomplished much more inexpensively than with prior art insulating shutters, interlocking slats, or thick quilted thermal insulating systems. The extra insulation available with such alternative thermal insulating systems may not provide sufficient incentive for their widespread adoption, particularly when installation skill requirements, cost and appearance factors are considered. Moreover, the sealing system requires no special carpentry skills to install, and permits use of existing window shades. Also, the snap-off side sealing members facilitate periodic removal of the shade, e.g. for cleaning or replacement. One particular feature and advantage of the present invention resulting from the provision of two piece edge seal assemblies including separate mounting strip members 18, 118 and sealing strip members 20, 120 is the ability to accommodate unevenness of the surfaces to which the edge seal assemblies are mounted. The reversibility of the strip member 118, the pivoting action of the bead and socket arrangement 121 and the design of sill seal and reinforcing member 140 of the second embodiment permits the accommodation of various angles of trim and window frame surfaces in order to permit the use of the construction of the second embodiment in a wide range of window designs and constructions.

While there has been described what is at present considered to be the preferred embodiment of this invention, various changes and modifications may be made therein without departing from the scope of the invention. For example, the sill sealing member 46 and top edge sealing member **46*a*** may comprise two piece assemblies including a mounting strip and snap-on mating sealing strip (or bead and socket system) similar in arrangement to the shade side sealing member assemblies.

We claim:

1. A roller shade seal system for a window shade comprising in combination:

a pair of edge seal assemblies in the form of elongate mounting strip members, adapted to be mounted to opposite faces of the window frame trim, and a pair of sealing strip members in the form of elongate, generally U-shaped channels adapted to sealably engage lateral edges of a said shade;

elongate snap-coupling means extending the length of said edge seal assemblies for releasably mounting each of said sealing strip members to an associated mounting strip member, adapted for mounting either one of said members within a window frame opening and on the surface of a window frame opening, said snap-coupling means comprising elongate bead means and socket means with the mounting strip members carrying one of the bead means and socket means while the sealing strip members carry the other of the bead means and socket means, the mounting strip members being reversible for alternative mounting in a window frame opening and on the face of a window frame opening, the socket means and bead means projecting from their respective carrying members at approximately 45° to the plane to be occupied by the shade, thereby to provide the alternative mounting wherein said bead means and socket means are adapted to accommodate up to approximately 30° of angular misalignment of a sealing strip member to a mounting strip member, mounted thereto, about the longitudinal direction of said bead means;

a shade bottom edge seal assembly comprising a rigid bottom strip reinforcing member for mounting onto the bottom end of a said shade; and a window sill sealing strip means adapted and arranged to cooperate with said shade bottom reinforcing member to provide a seal at said window sill; and a shade top seal having mounted thereon a resiliently deformable sealing means for sealably engaging the outer turn of a said shade adjacent the roller end.

2. A roller shade seal system as claimed in claim 1, and including resiliently deformable sealing means mounted within the inwardly directed walls of said U-shaped channels for sealably engaging said shade edges.

3. A roller shade seal system as claimed in claim 1, wherein said window sill sealing strip means is a generally L-shaped sill mounted flanged sealing strip and including resiliently deformably sealing means on said sill mounted sealing strip for sealably engaging said bottom strip reinforcing member.

4. A roller shade seal system as claimed in claim 1, wherein said window sill sealing strip means is a generally L-shaped sill mounted flanged sealing strip and including a resiliently deformable sealing means on said bottom strip reinforcing member for sealably engaging said sill mounted sealing strip.

5. A roller shade seal system as claimed in claim 1, wherein the reinforcing member and the window sill sealing strip means consist of a combined sill seal and reinforcing member for captively encompassing a said shade bottom end while permitting limited vertical movement of a shade relative to the combined member thereby to facilitate sealing engagement of the combined member with the sill when a shade so engaged is in a substantially fully lowered position.

6. A roller shade seal system as claimed in claim 5, including a resiliently deformable sealing means on said combined member for sealingly engaging said sill.

7. A roller shade seal system as claimed in claim 6, including a flange on said combined member adapted to act with said sealing means to maintain said combined member in a desired attitude when the combined member sealingly engages the sill.

8. A roller shade seal system as claimed in claim 5, including a resiliently deformable sealing means on said combined member to sealingly engage a shade so engaged.

9. A roller shade seal system as claimed in claim 1 wherein said reinforcing member engages said sealing strip members for guidance thereby during lowering and raising of a shade sealed by the system.

10. A roller shade seal system as claimed in any of claims 1 to 9, in combination with a retractable roller shade.

* * * * *